US007637480B2

(12) United States Patent
Weinel

(10) Patent No.: US 7,637,480 B2
(45) Date of Patent: Dec. 29, 2009

(54) EXTRICATION DEVICE AND METHOD THEREFOR

(75) Inventor: John T. Weinel, Lakeville, MN (US)

(73) Assignee: JTW Associates LLC, Lakeville, MN (US)

( * ) Notice: Subject to any disclaimer, the term of this patent is extended or adjusted under 35 U.S.C. 154(b) by 397 days.

(21) Appl. No.: 11/563,782

(22) Filed: Nov. 28, 2006

(65) Prior Publication Data

US 2008/0121285 A1 May 29, 2008

(51) Int. Cl.
*B66F 3/35* (2006.01)

(52) U.S. Cl. ..... 254/93 HP; 254/93 H

(58) Field of Classification Search ..... 254/93 HP, 254/2 B, 93 H, 93 R, 88
See application file for complete search history.

(56) References Cited

U.S. PATENT DOCUMENTS 3,994,474 A * 11/1976 Finkbeiner ..... 254/88
4,572,579 A * 2/1986 Saito ..... 298/1 A
5,802,650 A * 9/1998 Massey et al. ..... 14/71.3
6,092,788 A * 7/2000 Simon ..... 254/93 HP
6,918,575 B2 * 7/2005 Cadrain et al. ..... 254/88
6,929,249 B1 * 8/2005 Kim ..... 254/93 HP
2008/0121285 A1 * 5/2008 Weinel ..... 137/223
2008/0210917 A1 * 9/2008 Niklasson ..... 254/93 HP

* cited by examiner

*Primary Examiner*—Lee D Wilson
(74) *Attorney, Agent, or Firm*—Schwegman, Lundberg & Woessner P.A.

(57) ABSTRACT

An extrication device includes a first plate and a second plate adapted to be coupled to at least a portion of the first plate. An inflatable bladder is coupled at least partially between the first and second plates, wherein at least a portion of the first plate is generally proximate at least a portion of the second plate with the inflatable bladder in a deflated condition. The first and second plates are generally spaced apart with the inflatable bladder in an inflated condition.

24 Claims, 4 Drawing Sheets

EXTRICATION DEVICE AND METHOD THEREFOR

TECHNICAL FIELD

Extrication devices and in particular extrication devices usable in lifting and/or otherwise moving objects, such as vehicles.

BACKGROUND

Rescue workers such as firemen, paramedics, police officers, etc. often encounter situations in which it becomes necessary to move heavy objects, for instance when people become trapped underneath motor vehicles, pieces of collapsed buildings, and the like. Rapid extrication of a victim of such an accident is desirable so that the victim can not only avoid prolonged exposure to the dangerous situation, but can also receive medical attention as quickly as possible.

Lifting devices are currently used by rescue workers for extricating victims from such situations. In one example, mechanical jacks are used. However, mechanical jacks are often difficult to fit and operate within openings and crevices available under the object to be lifted. In some examples, jacks are prone to tipping over if not operated on a level surface.

In another example, inflatable bags are used to lift objects. Such inflatable bags typically require a separate source of compressed air, such as an air compressor, for inflation. Such inflatable bags often are difficult to position appropriately to lift an object. Moreover, use of such inflatable bags either requires a vehicle which includes an air compressor or is capable of transporting a separate stand-alone air compressor, which tend to be fairly large and unwieldy. Also, such inflatable bags typically are prone to being cut, punctured, or otherwise damaged by portions of the object being lifted, for instance, sharp metal or glass portions of automobile wreckage.

What is needed is an extrication device that overcomes the shortcomings of previous devices. What is further needed is an extrication device that is compact and portable, and is able to be inserted within small openings and crevices under/within objects to enable lifting/moving of the objects.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
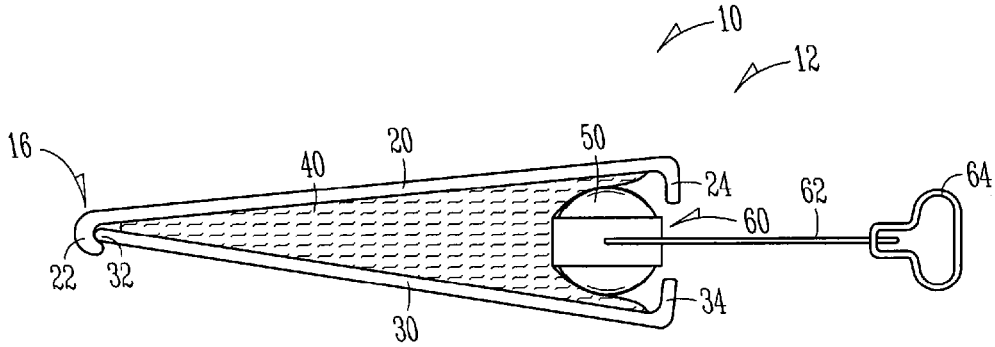
FIG. 1 is a side view of one example of an extrication device in a deflated condition.
Figure 2:
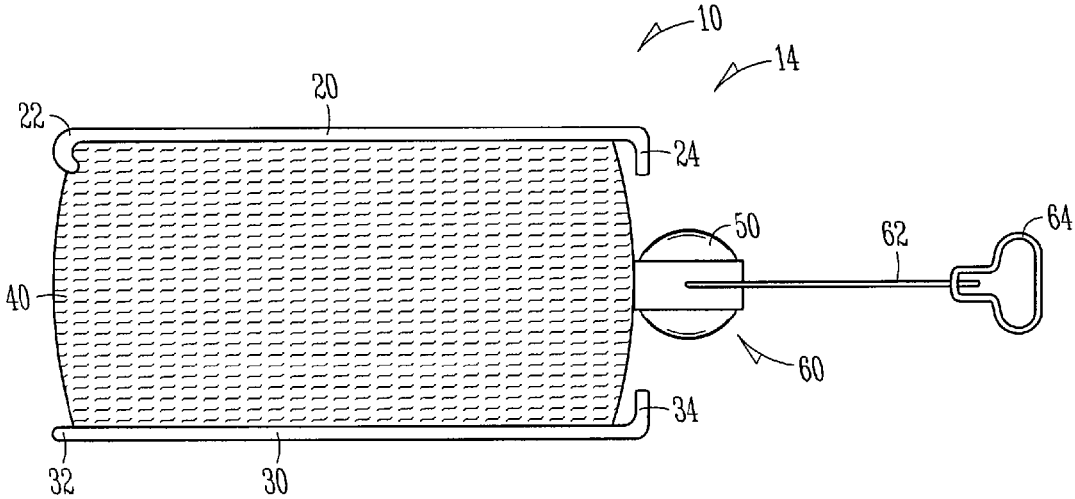
FIG. 2 is a side view of one example of the extrication device in an inflated condition.
Figure 3:
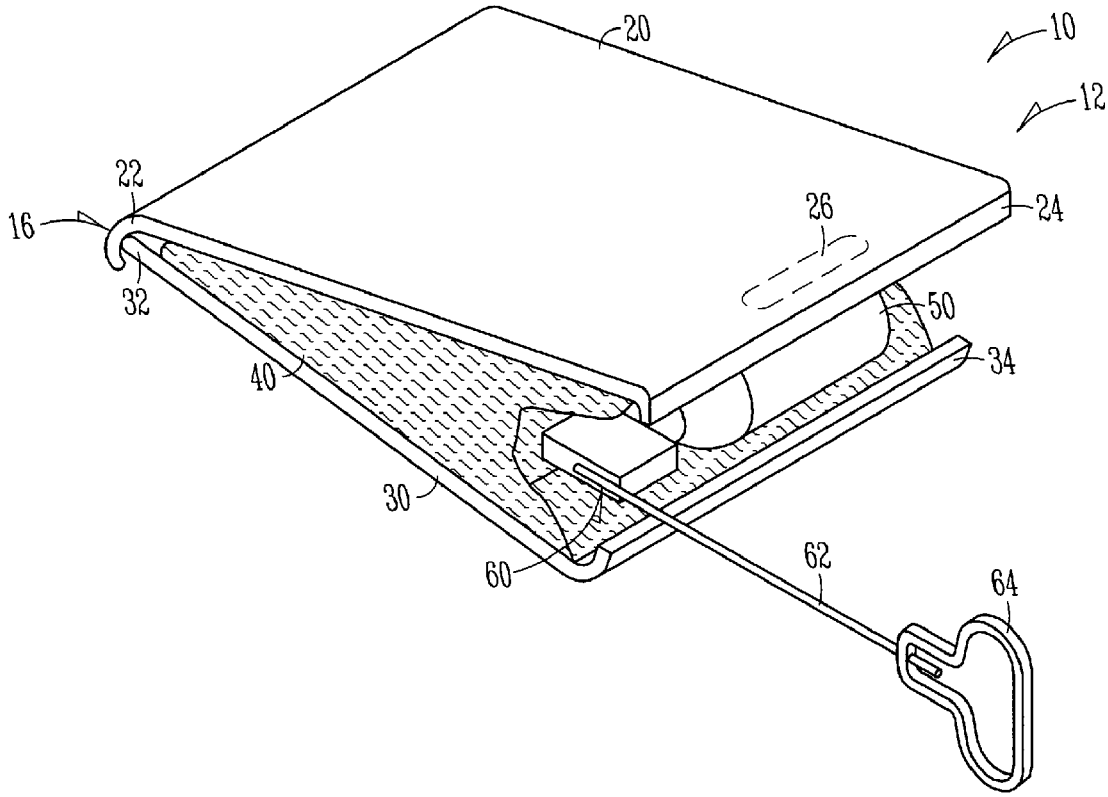
FIG. 3 is a perspective view of one example of the extrication device in the deflated condition.

One example of an extrication device is shown in FIGS. 1-3 as extrication device 10. The extrication device 10 includes a first plate 20 and a second plate 30 each coupled to an inflatable bladder 40, which is disposed at least partially between the first and second plates 20, 30. In one example, the inflatable bladder 40 is shaped such that the first and second plates 20, 30 are generally oppositely disposed from one another, for instance, the inflatable bladder 40 having a generally rectangular prismatic shape, a generally cylindrical shape, an ovoid-like shape, and the like. The first and second plates 20, 30, in one example, are attached to the inflatable bladder 40 using generally conventional methods, such as rivets, bolts, screws, stitching, adhesive, and the like. In another example, at least one of the first and second plates 20, 30 is retained by the inflatable bladder 40 within a pocket within the inflatable bladder 40. That is, the inflatable bladder 40 includes at least one pocket in a side thereof in which at least one of the first and second plates 20, 30 is placed to couple the at least one of the first and second plates 20, 30 with the inflatable bladder 40. In one example, the inflatable bladder 40 is made out of a resilient material and is constructed in a way that is substantially gas impermeable. In another example, the inflatable bladder 40 includes polyethylene, polypropylene, polyester, polyurethane, polyvinyl chloride, or the like. In yet another example, a suitable polymer is combined with fibrous polymers such as nylon or aramid fiber. The first and second plates 20, 30 are generally rigid in one example, the first and second plates 20, 30 being made of a material such as aluminum, steel, and the like. In one example, the first and second plates 20, 30 are generally rectangular in shape when viewed from above or below, although it is contemplated that the first and second plates 20, 30 be of different shapes, such as circular, ovular, triangular, and the like, provided the alternatively-shaped plates are capable of functioning as described herein. In one example, the first and second plates 20, 30 have generally flat surfaces facing outwardly from the extrication device 10.

Still referring to FIGS. 1-3, the extrication device 10 further includes a gas canister 50 and an opening mechanism 60 coupled thereto. The gas canister 50 contains a compressed gas (e.g., carbon dioxide, air, nitrogen, or the like). The gas canister 50 is coupled to the opening mechanism 60, for example, by screwing the gas canister 50 into threaded receptacles of the opening mechanism 60. In another example, the gas canister 50 is coupled to the opening mechanism 60 by a weld, an interference fit, and the like. The opening mechanism 60 is coupled to the inflatable bladder 40 to facilitate the flow of gas from the gas canister 50 to the inflatable bladder 40. In one example, the inflatable bladder 40, the gas canister 50, and the opening mechanism 60 form a generally compact unit to facilitate transporting, storage, handling, etc. of the extrication device 10.

Actuation of the opening mechanism 60 in one example allows gas from the gas canister 50 to begin filling the inflatable bladder 40. As shown in FIG. 1, a portion of the opening mechanism 60 includes a manual trigger, such as a rip cord 62. In one example, the rip cord 62 includes a handle 64 at an end thereof to aid the user in pulling the rip cord 62 to actuate the gas canister 50. The opening mechanism 60 includes a feature such as a needle, valve, and the like adapted to open the gas canister 50 when the rip cord 62 is pulled. In this way, pulling of the rip cord 62 at least partially opens the gas canister 50 to allow gas from the gas canister 50 to enter the inflatable bladder 40.

In one example, the gas canister 50 is sized and shaped so that a capacity of the gas canister 50 is at least sufficient to entirely fill the inflatable bladder 40. In another example, the gas canister 50 has a sufficient capacity to partially fill the inflatable bladder 40. In another example, the gas canister 50 has a sufficient capacity to fill the inflatable bladder 40 more than once. In yet another example, the gas canister 50 has a sufficient capacity to fill the inflatable bladder 40 at least once with assistance from at least one venturi or other such device. While the above examples each discuss the use of the gas canister 50 to inflate the inflatable bladder 40, it is contemplated that the inflatable bladder 40 be inflated in another way, such as using a controlled pyrotechnic charge, dry ice, and the like, for instance.

The inflatable bladder 40 has at least a deflated condition 12 (FIG. 1) and an inflated condition 14 (FIG. 2). In one example, placing the inflatable bladder 40 in the deflated condition 12 allows portions of the first and second plates 20, 30 to be proximate one another, and placing the inflatable bladder 40 in the inflated condition 14 allows the first and second plates 20, 30 to be generally spaced apart. In another example, the portion of the first plate 20 is engaged against the portion of the second plate 30 with the inflatable bladder 40 in the deflated condition 12. The first and second plates 20, 30, in another example, are selectively coupled when the inflatable bladder 40 is in the deflated condition 12. In yet another example, a portion of the first plate 20 is a first engagement feature 22, and a portion of the second plate 30 is a second engagement feature 32, with the first engagement feature 22 interlocking with the second engagement feature 32 to form a tip 16 or a leading edge. In one example, the first engagement feature 22 is generally hook-shaped and extends along one side of the first plate 20 and is sized and shaped to selectively accommodate the second engagement feature 32, which is essentially a generally straight edge of the second plate 30, within a generally concave inner surface of the hook-shaped first engagement feature 22. Such a configuration of the first and second engagement features 22, 32 enables the selective engagement of the first and second engagement features 22, 32 while also allowing relatively easy disengagement, if desired and/or during inflation of the inflatable bladder 40. In another example, the generally hook-shaped engagement feature extends along one side of the second plate 30 and is sized and shaped to selectively accommodate a generally straight edge of the first plate 20, in a manner similar to that described above.

The tip 16, in one example, facilitates placement of the extrication device 10 within cracks, crevices, and other openings in and/or under an object to be lifted or otherwise moved, such as an automobile 90 (FIGS. 4 and 5), for instance. That is, by interlocking the first and second engagement features 22, 32 with the inflatable bladder 40 in the deflated condition 12, the tip 16 and the first and second plates 20, 30 create, in one example, a generally angled, wedge-shaped configuration, which allows a user to place, force, ram, etc. the extrication device 10 within crevices in and/or under the object. In another example, the tip 16 forms a generally acute angle leading edge between the first and second plates 20, 30. Optionally, to facilitate placement of the extrication device 10 by the user, the first plate 20 can include at least one handle 26 (shown in phantom in FIG. 3), which can be grasped by the user during placement of the extrication device 10. It is contemplated that the second plate 30 can include a similar handle therein to further facilitate lifting, carrying, and placement of the extrication device 10.

In one example, one or both of the first and second plates 20, 30 include flanges 24, 34 disposed along opposite edges of the first and second plates 20, 30 from the first and second engagement features 22, 32. In one example, the flanges 24, 34 extend generally perpendicular with respect to the first and second plates 20, 30, although it is within the spirit and scope of the present invention that the flanges 24, 34 be configured differently provided they perform in the manner discussed herein. The flanges 24, 34 serve a number of purposes, including providing a surface area increased from that of just the edge of the first and/or second plates 20,30 for a user to strike with shoes, boots, or other footwear; hands; hammers; or the like during forcing of the extrication device 10 within a crevice, crack, void, or other space. The flanges 24, 34 can further function to provide protection of the gas canister 50 and opening mechanism 60 at least when the inflatable bladder 40 is in the deflated condition 12. In particular, the flanges 24, 34 serve a protective function for the gas canister 50 and opening mechanism 60 during use, and especially while the user is striking the extrication device 10 to force the extrication device 10 into a crevice, crack, void, or other space. Additionally, the flanges 24, 34 can function to aid in compartmentalizing the extrication device 10, for instance, during storage. That is, when deflated, the gas canister 50, the inflatable bladder 40, and the opening mechanism 60 can be substantially enclosed between the first and second plates 20, 30, thereby providing a discrete, relatively durable unit that can be relatively easily stored, for instance, in the trunk of a car or a storage compartment of a rescue vehicle, such as a fire truck or ambulance.

Figure 4:
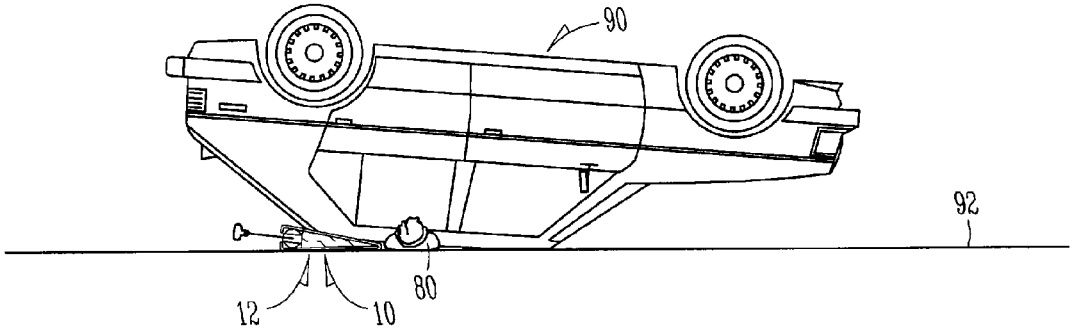
FIG. 4 is a side view of one example of the extrication device in the deflated condition positioned under an object to be lifted.
Figure 5:
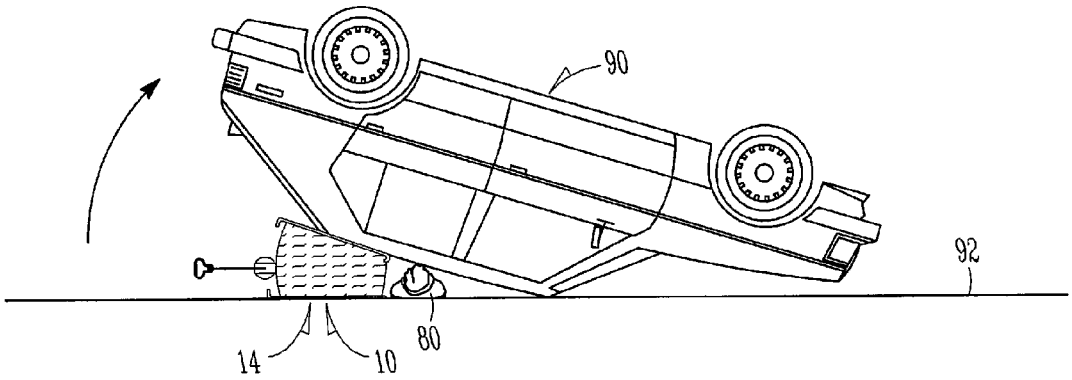
FIG. 5 is a side view of one example of the extrication device in the inflated condition lifting the object.

In operation, referring to FIGS. 4 and 5, one example of the extrication device 10 is used to lift and/or move an object away from a victim 80 trapped thereby. In this example, the object being lifted is an automobile 90. It is noted that the use of the extrication device 10 is not intended to be limited to the lifting and/or moving of automobiles, as the extrication device 10 is capable of lifting and/or moving other objects, including fallen tree limbs, pieces of collapsed buildings, and the like. If a victim 80 becomes at least partially pinned, for instance, between an automobile 90 and a surface 92 such as the ground, a rescue worker or other individual in possession of the extrication device 10 can position the extrication device 10 in the deflated condition 12 between the automobile 90 and the surface 92, such that the first plate 20 faces and/or abuts a portion of the automobile 90 and the second plate 30 faces and/or abuts the surface 92, or vice versa. The user can strike the flanges 24, 34 with feet, hands, or a tool such as a sledgehammer or the like to urge the extrication device 10 into the desired position. Once appropriately positioned, the rip cord 62 of the extrication device 10 can be pulled to begin inflation of the inflatable bladder 40. Referring specifically to FIG. 5, inflation of the inflatable bladder 40 causes separation of the first and second plates 20, 30 to create a lifting and/or moving force, which lifts and/or moves the automobile 90 sufficiently to free the victim 80, so that the victim 80 can be removed from the at least partially pinned position under the automobile 90.

Figure 6:
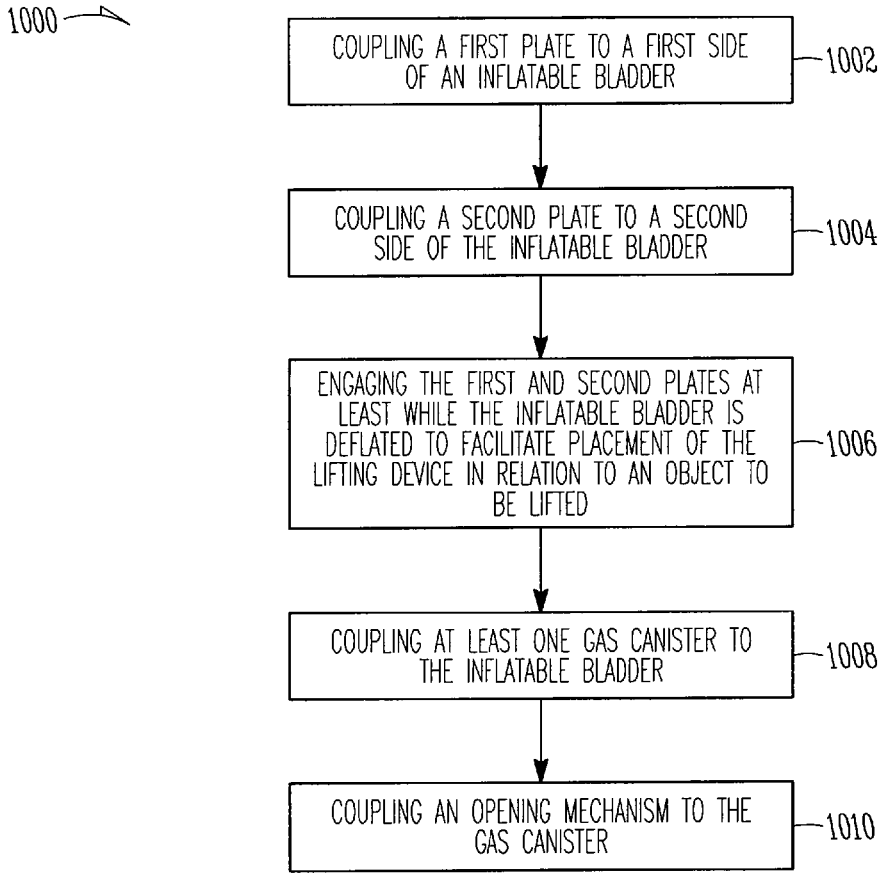
FIG. 6 is a block diagram showing one example of a method of making an extrication device.

FIG. 6 shows one example of a method 1000 for making an extrication device. One example of an extrication device 10 made with the method 1000 is shown in FIGS. 1-5, and is referenced below. At 1002, a first plate 20 is coupled with a first side of an inflatable bladder 40. At 1004, a second plate 30 is coupled to a second side of the inflatable bladder 40. The second side of the inflatable bladder 40 is generally oppositely disposed from the first side. Inflation of the inflatable bladder 40 causes separation of the first and second plates 20, 30 to create a lifting and/or moving force. In one example, at 1006, the first and second plates 20, 30 are engaged at least while the inflatable bladder 40 is deflated to facilitate placement of the extrication device 10 in relation to an object being lifted and/or moved. In another example, at 1008, at least one gas canister 50 is coupled to the inflatable bladder 40. Optionally, the method 1000 further includes, at 1010, coupling an opening mechanism 60 to the gas canister 50.

Figure 7:
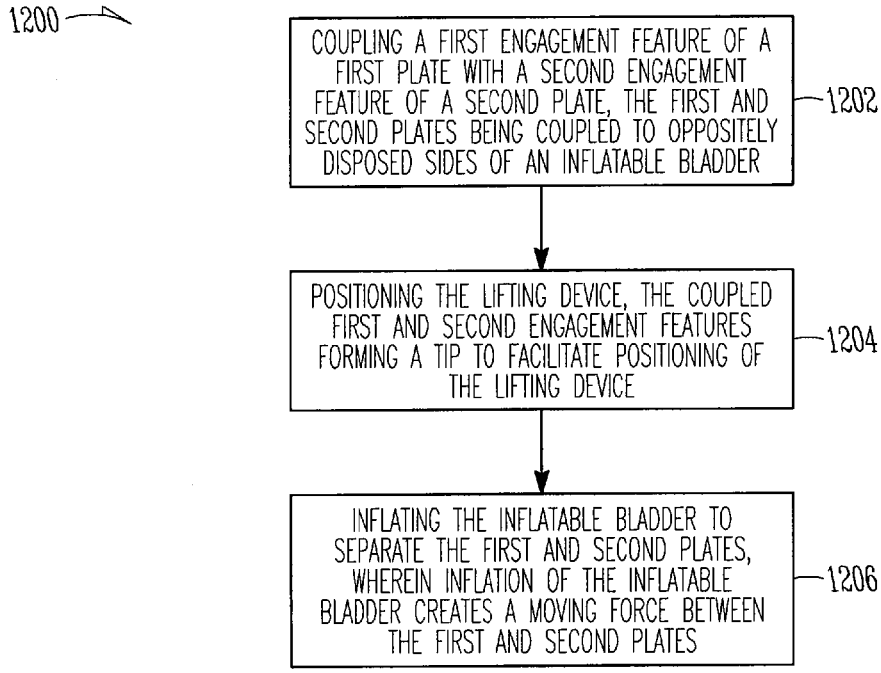
FIG. 7 is a block diagram showing one example of a method of using an extrication device.

Referring to FIG. 7, one example of a method 1200 for using an extrication device is shown. One example of an extrication device 10 used with the method 1200 is shown in FIGS. 1-5, and is referenced below. At 1202, a first engagement feature 22 of a first plate 20 is coupled with a second engagement feature 32 of a second plate 30. The first and second plates 20, 30 are coupled to oppositely disposed sides of an inflatable bladder 40. At 1204, the extrication device 10 is positioned. The coupled first and second engagement features 22, 32 form a tip 16 to facilitate positioning of the extrication device 10. In one example, the extrication device 10 is positioned adjacent an object 90 to be moved. Positioning the extrication device 10 includes, in one example, applying force to a flange 24 or flanges 24, 34 of at least one of the first and second plates 20, 30 to urge the extrication device 10 into a desired position. The inflatable bladder 40 is then inflated at 1206 to separate the first and second plates 20, 30, wherein inflation of the inflatable bladder 40 creates a moving force between the first and second plates 20, 30. In one example, the inflatable bladder 40 imparts the moving force on the object 90 to move at least a portion of the object 90. Inflating the inflatable bladder 40, in one example, includes triggering an opening mechanism 60 to allow gas from a gas canister 50 to at least partially inflate the inflatable bladder 40.

At least one of the above-discussed examples of the extrication device 10 is intended to be a relatively small, compact device capable of fitting within the trunk of a police vehicle, ambulance, or other vehicle. Because at least one example of the extrication device 10 includes the self-contained gas canister 50 for selectively inflating the inflatable bladder 40, no separate compressor or other such inflation device need be present in order to operate the extrication device 10, thereby enhancing the portability of the extrication device 10. Additionally, the above-discussed configuration of the first and second plates 20, 30 of the extrication device 10 provide relatively stable surfaces through which to apply force, in that the first and second plates 20, 30 allow the extrication device 10 to be seated relatively firmly against the surface 92 and the automobile 90, for example, even if the areas of the surface 92 and the automobile 90 are at least slightly uneven. In this way, the extrication device 10 is less prone to tipping. Also, with at least some of the examples discussed above, the extrication device 10 is inflated with a single pull of the rip cord 62 and does not require repeated actuation of a crank or jack handle, as is necessary with conventional lifting devices such as jacks. As such, the extrication device 10 can be operated within areas in which conventional lifting devices would not be able to be used because of the lack of accessibility to the crank or jack handle or the lack of room to operate the crank or jack handle.

The extrication device 10 of at least some of the examples discussed above is easier to place within cracks, crevices, and other openings in and/or under an object to be lifted or otherwise moved than at least some conventional lifting devices because of the tip 16 or leading edge of the extrication device 10. For instance, by interlocking the first and second engagement features 22, 32 with the inflatable bladder 40 in the deflated condition 12, a generally angled, wedge-shaped configuration is formed, which allows a user to place, force, ram, etc. the extrication device 10 within crevices in and/or under the object. Additionally, the at least one handle 26 (shown in phantom in FIG. 3) in at least the first plate 20 further facilitates placement of the extrication device 10 by providing a location for the user to grasp in handling, positioning, etc. the extrication device 10.

Also, because the first and second plates 20, 30 and tip 16 or leading edge are configured to at least partially surround the inflatable bladder 40, damage to the inflatable bladder 40 from, for instance, sharp portions of the object being lifted is at least inhibited. That is, the tip 16 along with the first and second plates 20, 30 at least partially protects the inflatable bladder from penetration of foreign objects. In this way, unlike the generally known inflatable bags, which, as stated above, are typically prone to being damaged by portions of the object being lifted, the first and second plates 20, 30 and tip 16 or leading edge provide at least some protection to the inflatable bladder 40.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. An extrication device, comprising:

a first plate;

a second plate adapted to be coupled to at least a portion of the first plate;

an inflatable bladder coupled at least partially between the first and second plates, wherein at least the portion of the first plate is generally proximate at least a portion of the second plate with the inflatable bladder in a deflated condition, and the first and second plates are generally spaced apart with the inflatable bladder in an inflated condition, and an opening mechanism coupled to the inflatable bladder, the opening mechanism including a rip cord.

2. The extrication device of claim 1, wherein the portion of the first plate is engaged against the portion of the second plate with the inflatable bladder in a deflated condition.

3. The extrication device of claim 1, wherein, with the inflatable bladder in a deflated condition, the first and second plates are selectively coupled.

4. The extrication device of claim 3, wherein the portion of the first plate selectively interlocks with the portion of the second plate to form a tip.

5. The extrication device of claim 4, wherein the tip at least partially protects the inflatable bladder from penetration of foreign objects.

6. The extrication device of claim 1, further comprising at least one gas canister operatively coupled to the inflatable bladder.

7. The extrication device of claim 1, wherein the first and second plates are rigid.

8. The extrication device of claim 1, wherein inflation of the inflatable bladder causes separation of the first and second plates to create a moving force.

9. The extrication device of claim 1, wherein at least one of the first and second plates includes a flange.

10. The extrication device of claim 9, wherein the flange at least partially surrounds at least a gas canister to provide at least some protection of the gas canister during use.

11. An inflatable extrication device, comprising:

an inflatable bladder having first and second oppositely disposed sides;

a first plate coupled to the first side of the inflatable bladder, the first plate including a first engagement feature;

a second plate coupled to the second side of the inflatable bladder, the second plate including a second engagement feature selectively engageable with the first engagement feature; and an opening mechanism coupled to the inflatable bladder, wherein the opening mechanism includes a rip cord.

12. The inflatable extrication device of claim 11, wherein at least the first engagement feature is generally proximate at least the second engagement feature with the inflatable bladder in a deflated condition, and the first and second plates are generally spaced apart with the inflatable bladder in an inflated condition.

13. The inflatable extrication device of claim 11, wherein the first engagement feature selectively interlocks with the second engagement feature to form a tip.

14. The inflatable extrication device of claim 13, wherein the first and second plates and the tip at least partially protects the inflatable bladder from penetration of foreign objects.

15. The inflatable extrication device of claim 11, further comprising at least one gas canister operatively coupled to the inflatable bladder.

16. The inflatable extrication device of claim 11, wherein at least one of the first and second plates includes a flange.

17. The inflatable extrication device of claim 16, wherein the flange at least partially surrounds at least a gas canister to provide at least some protection of the gas canister during use.

18. An inflatable extrication device, comprising:

an inflatable bladder having first and second oppositely disposed sides;

a first plate coupled to the first side of the inflatable bladder, the first plate including a first engagement feature;

a second plate coupled to the second side of the inflatable bladder, the second plate including a second engagement feature selectively couplable with the first engagement feature, wherein the coupled first and second engagement features are configured to form a tip; and an opening mechanism coupled to the inflatable bladder, wherein the opening mechanism includes a rip cord.

19. The inflatable extrication device of claim 18, wherein the tip forms a generally acute angle between the first and second plates.

20. The inflatable extrication device of claim 19, wherein the first engagement feature includes a concave inner surface sized and configured to selectively accept the second engagement feature for coupling of the first and second plates.

21. The inflatable extrication device of claim 18, wherein the first and second plates are generally rigid.

22. The inflatable extrication device of claim 18, further comprising at least one gas canister operatively coupled to the inflatable bladder.

23. The inflatable extrication device of claim 18, wherein at least one of the first and second plates includes a flange disposed at least partially along an edge opposite from at least one of the first and second engagement features.

24. The inflatable extrication device of claim 18, wherein at least the tip at least partially protects the inflatable bladder from penetration of foreign objects.

* * * * *

UNITED STATES PATENT AND TRADEMARK OFFICE

CERTIFICATE OF CORRECTION

PATENT NO. : 7,637,480 B2
APPLICATION NO. : 11/563782
DATED : December 29, 2009
INVENTOR(S) : John T. Weinel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 428 days.

Signed and Sealed this

Twenty-first Day of December, 2010

David J. Kappos

David J. Kappos
*Director of the United States Patent and Trademark Office*